United States Patent [19]

Turpin et al.

[11] 3,940,496

[45] Feb. 24, 1976

[54] SPIRAL WOUND CAN HAVING DISCRETE LABEL AND REINFORCING ELEMENTS

[75] Inventors: Charles H. Turpin; Francis R. Reid; James R. Leezer, all of Minneapolis, Minn.

[73] Assignee: The Pillsbury Company, Minneapolis, Minn.

[22] Filed: Aug. 13, 1973

[21] Appl. No.: 387,830

[52] U.S. Cl. ..... 426/123; 229/4.5; 229/51 BP; 426/87; 426/126; 426/128

[51] Int. Cl.[2] ..... B65D 85/36; B65D 5/54

[58] Field of Search ..... 229/51 ST, 51 WB, 51 AS, 229/51 D, 51 BP, 4.5; 206/813, 525; 426/128, 126, 123, 87

[56] References Cited

UNITED STATES PATENTS

| | | | |
|---|---|---|---|
| 2,795,366 | 6/1957 | Magill | 229/51 BP |
| 2,891,714 | 6/1959 | Vallas | 229/51 BP |
| 3,035,753 | 5/1962 | Erekson | 229/51 BP |
| 3,101,885 | 8/1963 | Walsh | 229/51 BP |
| 3,102,818 | 9/1963 | Zoeller et al. | 229/51 BP |
| 3,174,676 | 3/1965 | Stump et al. | 229/51 BP |
| 3,241,739 | 3/1966 | Ahlemeyer | 229/51 BP |
| 3,304,185 | 2/1967 | Fortney | 229/51 BP |

FOREIGN PATENTS OR APPLICATIONS

| | | | |
|---|---|---|---|
| 900,439 | 7/1962 | United Kingdom | 229/51 BP |

*Primary Examiner*—William Price
*Assistant Examiner*—Bruce H. Bernstein
*Attorney, Agent, or Firm*—James V. Harmon; Michael D. Ellwein

[57] ABSTRACT

A spiral wound can is described in which the body of the can is made up of a relatively heavy fiberboard base or body layer lined within by an oil and moisture impermeable barrier formed from a laminate of aluminum foil and paper. The heavy base layer includes a helically extending separation line or butt joint bonded together by the liner and a reinforcing tensile element in the form of a reinforcing strip. A discrete label covers the reinforcing strip and the body stock and is bonded to the body stock by at least two broken or unbroken lines of adhesive on opposite sides of the reinforcing strip. A circumferentially extending collar cut is made through both the label and the reinforcing strip to facilitate their removal. In one form of the invention, the reinforcing strip is bonded more strongly to the label than to the body and is removed when the label is removed. In another form of the invention, the label is not bonded to the reinforcing strip and is removed first. The reinforcing strip is in the second form provided with an adhesive free area under one corner which defines a lifting tab allowing it to be lifted manually and removed.

6 Claims, 10 Drawing Figures

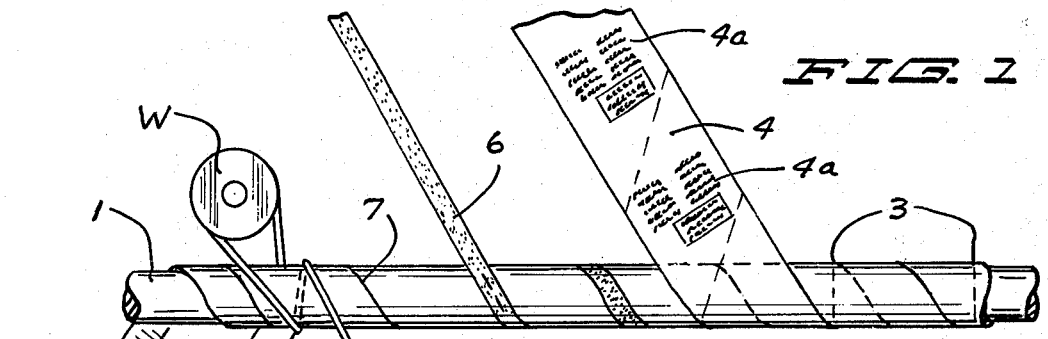
FIG. 1
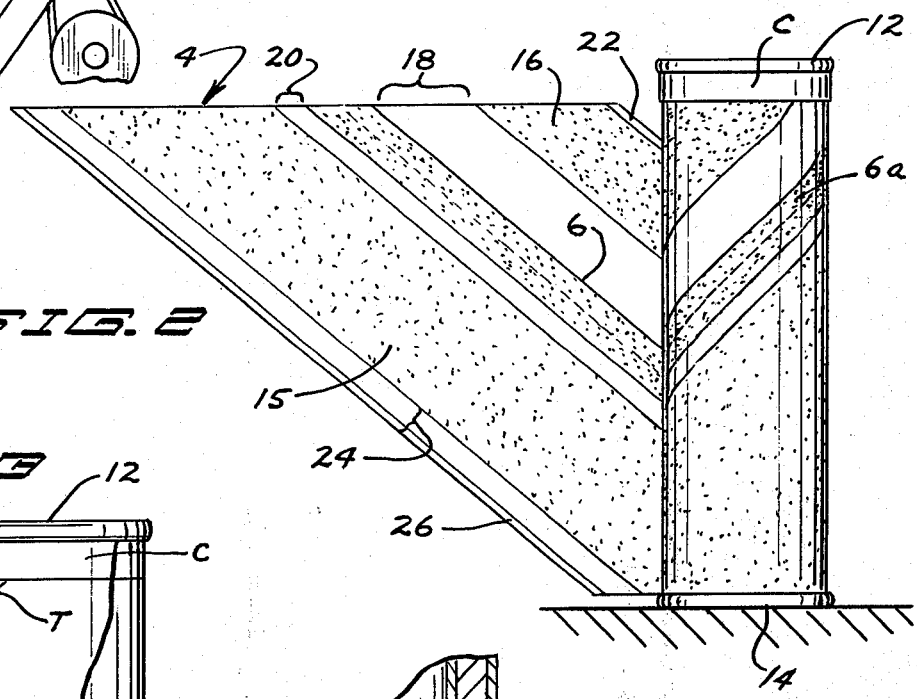
FIG. 2
FIG. 3
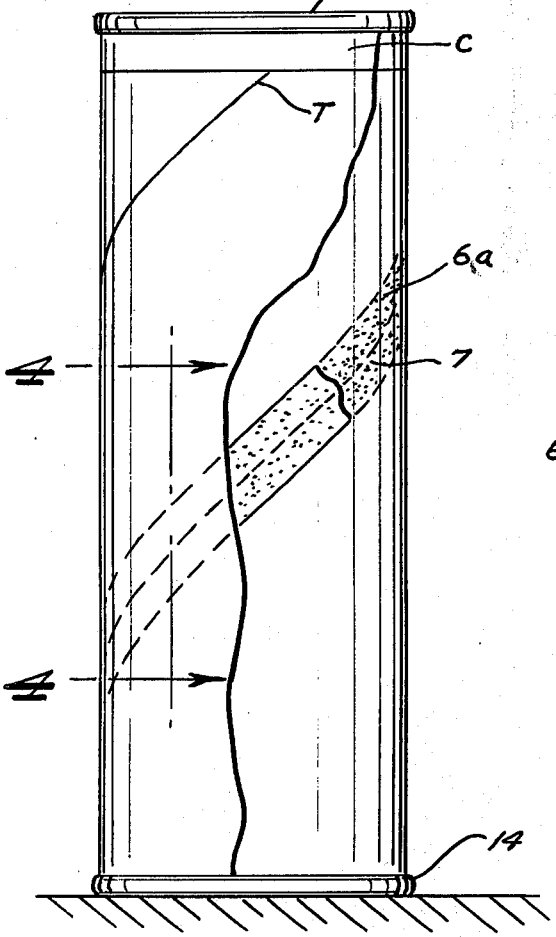
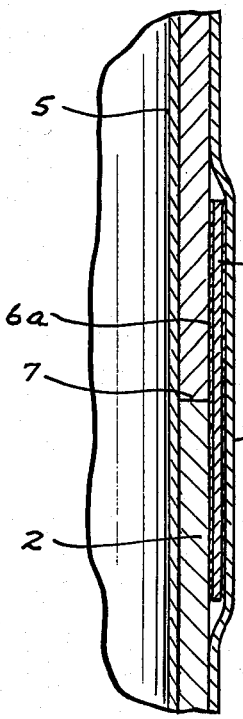
FIG. 4

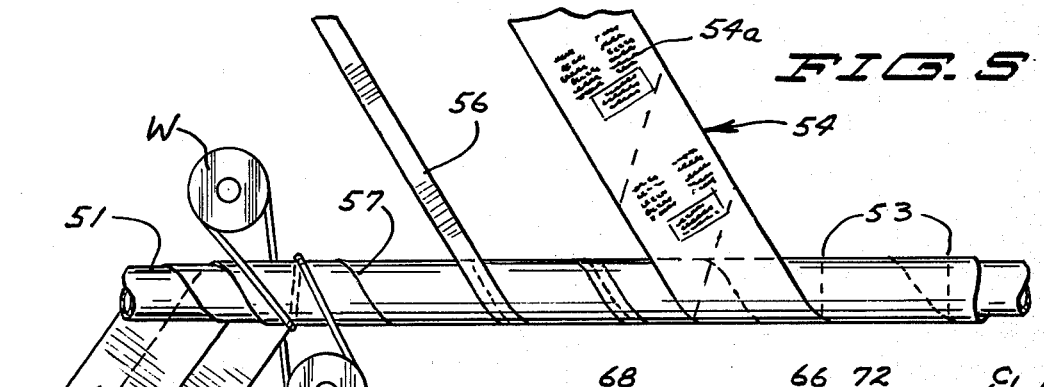
FIG. 5
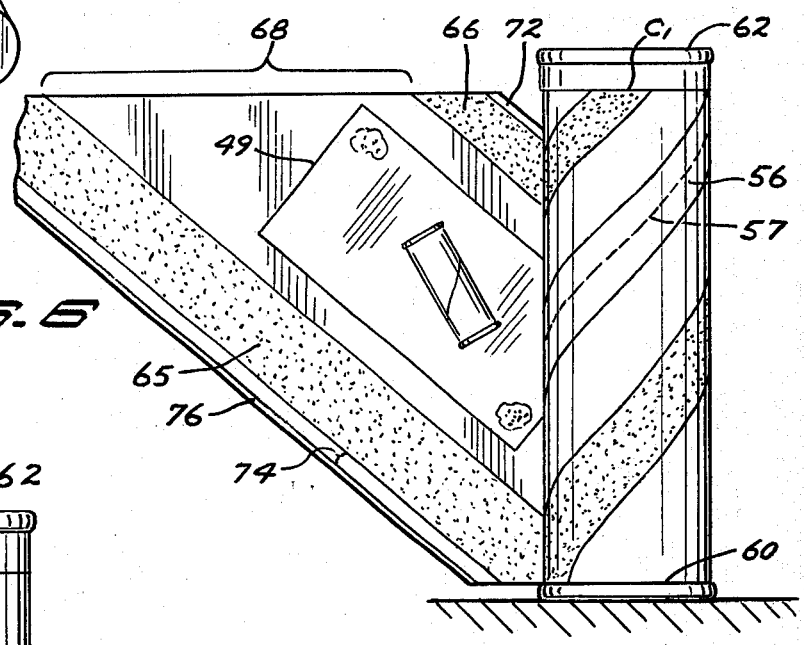
FIG. 6
FIG. 7
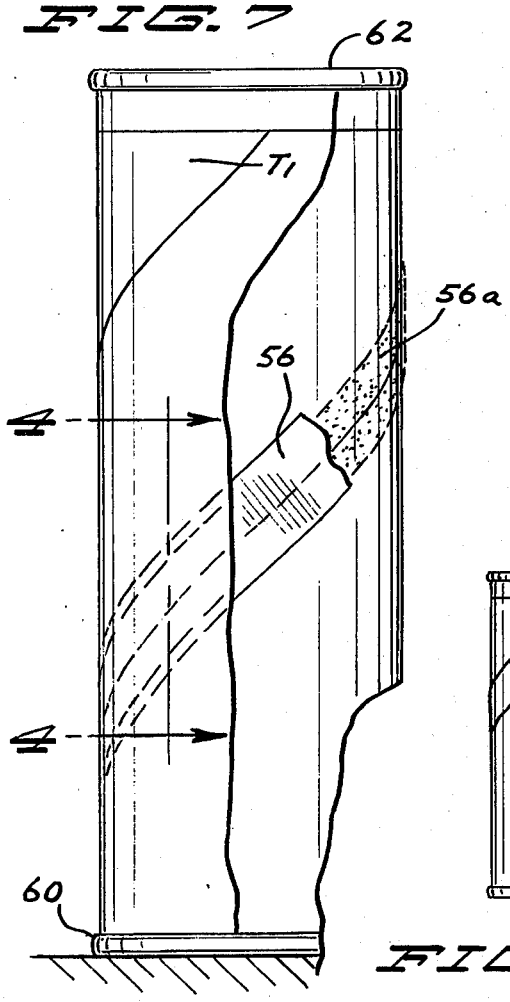
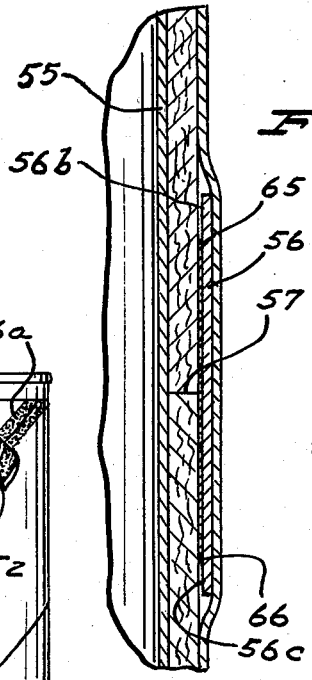
FIG. 8
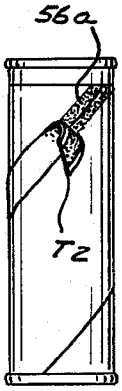
FIG. 9
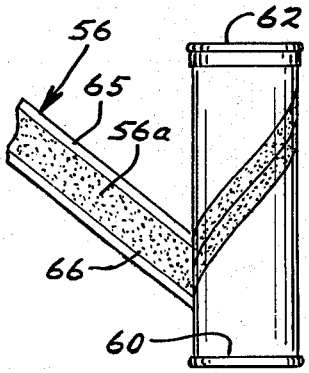
FIG. 10

SPIRAL WOUND CAN HAVING DISCRETE LABEL AND REINFORCING ELEMENTS

THE PRIOR ART

A large number of pressurized cans for refrigerated dough products are currently made under U.S. Pat. Nos. 2,793,126 and 2,793,127 and 3,144,193. These patent describe helically wound fiber cans composed of a relatively thick central fiberboard bodystock layer covered on the inside and outside by helically wound liner and label layers respectively. The label is entirely removed before the can is to be opened. The can is then struck against a solid object causing the liner to split along a separation line defined by a helical butt joint in the fiber body stock that extends the entire length of the can. In these prior containers it is highly desirable to be able to inlude as much descriptive matter as possible to show the consumer how to open the package and use the product or to provide coupons and the like. Previously, little printed matter could be provided on the inside surface of the label because the label serves not only as a supporting medium for printed matter but also as an integral structural member of the container in maintaining the butt joint intact and it is necessary to glue the label to the body stock on either side of the butt joint. Moreover, to seal the butt joint successfully, the label must be made of material having the requisite strength, usually a super wet-strength paper (wet-strength 40% of dry-strength) with an additional foil grease and stain masking repellent layer which functions in addition as a printing surface. Labels of this material are expensive; at the present time about 7 to 9.5 cents per 1,000 square inches.

U.S. Pat. No. 3,366,493 describes a helically wound fiber can superficially similar to the present invention in that it is provided with a reinforcing strip bonded over a helical butt joint and a label. However, the reinforcing strip is never removed and the can when it is opened, opens along a series of perforations that extend parallel to the butt joint. The problem with this container is that the perforated separation line must be relatively difficult to rupture if the container is to have the requisite strength after the label is removed. While the can could be made easier to open by reducing the strength of the perforation line, the cans would then be more likely to burst prematurely either on the shelves or during the opening process which is, of course, a substantial disadvantage. Accordingly, a compromise must be made between a perforation line of relatively low strength which is easy to open but which might burst prematurely and a higher strength perforation line which securely retains the can intact but requires possibly two to three hard raps against a solid edge to be opened. In either case, a substantial safety margin has to be provided to allow for manufacturing tolerances in the liner, paperboard, bodystock and the precise dimensions of the perforation line including the changes from time to time in the length and width of the perforation cuts.

Other cans have been provided with reinforcing strips among these being U.S. Pat. Nos. 3,510,050 and 3,147,902 in which the strips are not removed at any time. U.S. Pat. No. 3,035,753 describes a helically wound fiber container for dough products with a removable reinforcing strip in which the label is not to be removed from the can but is instead torn by the reinforcing strip when the strip is removed. Thus, the label cannot provide space for additional printing on its inside surface which is an important object of the present invention.

THE OBJECTS

The primary objects of the invention are to provide an improved fiber can with the following characteristics and advantages for shipping and storing dough products under pressure: (a) the provision of substantially increased surface area for printing, for example, up to half again more printing area than the cylindrical surface of the can, (b) the provision of a single helical separation line with a means for substantially reducing the opening strength of this separation line e.g. by at least about 20% immediately before opening the can, (c) the provision of a can of the type described having a label of reduced cost, (d) a reinforcing strip bonded over the helical separation line and a reliable provision for allowing the reinforcing strip to be readily grasped and withdrawn when it is to be removed, (e) the provision of an alternative mode of opening wherein both the label and reinforcing strip can be removed at the same time, (f) the provision of an improved container of the type described wherein the cost of the label is reduced substantially by reliance upon a separate strip to provide a large portion of the strength needed to reinforce the separation line thereby dividing the label display function and the reinforcing functions between two different elements, (g) the provision of an improved can having as much as one half of its inside surface free from adhesive and printed indicia in the area that is free from adhesive.

SUMMARY OF THE INVENTION

A spiral wound can is described in which the body of the can is made up of a relatively heavy fiberboard base or body stock layer lined within by a relatively thin oil and moisture impermeable barrier formed, for example, from a laminate of aluminum foil and paper. The body stock layer includes a helically extending separation line which consists of a butt joint the edges of which are bonded together on the outside surface of the body stock by a reinforcing tensile element usually in strip form. A discrete label covers the reinforcing strip and body stock layer and is bonded thereto with adhesive. A circumferentially extending collar cut is made through both the label and the reinforcing strip to facilitate their removal. A means is provided to permit removal of the strip from the underlying body stock. This means can take one of several forms. In one form, the reinforcing strip is provided with adhesive bonds of differing strength on its opposed surfaces, the bond to the label being stronger than the bond to the body stock such that the strip is removed from the body stock when the label is removed. In another form of the invention, the reinforcing strip is not bonded to the label which is removed first. In this form of the invention the reinforcing strip is provided with an adhesive free area under one corner which defines a lifting tab allowing it to be lifted manually and removed.

THE FIGURES

FIG. 1 is a diagram illustrating the forming containers in accordance with one form of the invention.

FIG. 2 is a side elevational view of the can with a portion of the label removed.

FIG. 3 is a side elevational view of the can on a somewhat larger scale partially in section.

FIG. 4 is a vertical, sectional view taken on line 4—4 of FIG. 3.

FIG. 5 is a diagramatic view illustrating the manner of making another form of the invention.

FIG. 6 is a side elevational view of the can formed as shown in FIG. 5 with a portion of the label removed.

FIG. 7 is a side elevational view of the can of FIG. 6 on a somewhat larger scale with the label partially removed.

FIG. 8 is a vertical, sectional view taken on line 8-8 of FIG. 7.

FIG. 9 is a view similar to FIG. 7 showing the reinforcing strip partially removed and FIG. 10 is a view similar to FIG. 9 showing the reinforcing strip almost completely removed.

DESCRIPTION OF THE PREFERRED EMBODIMENT

A winding mandrel of standard construction is provided with the usual winder W having a belt or the like entrained over the mandrel for drawing the various webs including the body stock 2 onto the mandrel. The body stock sheet 2 and liner 5 are wound continuously onto the mandrel and travel from left to right in the figures thereby forming a helically extending butt joint 7 where the adjacent convolutions of the body stock 2 contact one another. Over the butt joint 7 is wrapped a reinforcing tape 6 which can be thought of as a tensile member. The tensile member is adhered to the body stock by means of adhesive 6a suitably applied to the strip 6 just before winding.

The liner 5 formed from a relatively tough barrier material such as the composite of kraft paper and aluminum foil is applied to the mandrel and wound inside the body stock 2 with adhesive applied to the body stock to bond the liner therein and to bond it to the body stock 2 in the area of the joint 7 to thereby reinforce the joint.

After the tensile member 6 has been bonded over the outside of the butt joint 7, a label 4 which functions as a protective coating and printing surface is applied and bonded by adhesive suitably applied to the underlying body stock in the locations described below and to the tape 6. After the tube has been completely formed in this manner, it is ultimately cut into can lengths as shown by dotted lines 3. The tube is then cut circumferentially only partially through its thickness specifically through the label 4 and the tensile element 6 at C. The cut C does not extend through the body stock layer 2 and is located relatively close to one end of the container, normally about one half of an inch from one end. By "relatively close to the end" is meant that the collar cut should be placed no more than about 2 or 3 inches from the end of the container. The container is now ready for filling and capping.

The finished package embodying the present invention is thus comprised of an elongated cylindrical container body. The butt joint 7 extends generally longitudinally and helically of the can. The inner protective layer formed from flexible sheet material is positioned adjacent and bonded to the inner wall of the body stock to help prevent the loss of moisture and oil from the can. The outer label 4 is positioned adjacent to the outer surface of the core 2 as mentioned above to provide a printing surface and to prevent ambient moisture from harming the container body and its contents. The tensile member 6 bridges the butt joint 7 and is adhered to the marginal edges of the container body element 2 adjacent and on either side of the butt joint by means of a suitable adhesive such as a resin emulsion or hot melt adhesive.

The bottom cap 14 is normally applied before filling. After the container is filled with dough products, the cover 12 is secured to the top. The bottom covers are secured in place conventionally by crimping or seaming with commercially available equipment.

As seen in FIGS. 2, 3 and 4, the body member is relatively thick compared with the liner and the label. It consists of heavy paperboard, for example 0.026 inches in thickness and functions as a stiffening member to provide shape, thickness, and overall strength. The liner 5 consists, for example, of 25 lb. per 3000 ft. square kraft paper laminated to 0.00035 inch thick aluminum foil. The inner layer of liner 5 is bonded to the core 2 by means of adhesive and by bridging the butt joint 7, holds the butt joint intact even after the removal of the label and tensile member 6 as will be described below.

The label 4 on the outside of the package can be much lighter in construction than an ordinary label.

The label 4, since it need not provide the tensile requirements for bonding together the butt joint 7, can be formed from any relatively lightweight sheet material especially well-adapted as a printing surface. It can, for example, be formed from any suitable flexible sheet material such as laminates of paper and foil as mentioned above but can be of other construction such as 45–55 pounds per ream clay coated bleached kraft either super-calendered or machine glazed. The clay coating is of a type treated with a chrominum complex to reduce grease wicking. Moisture and oil surface resistance is provided by suitable coatings e.g. vinyl coatings applied on the printing press as a part of the printing operation.

Each surface of the tensile member 6 is adhesively bonded to the adjacent material on its outer and inner surfaces. An important feature of this form of the invention is the provision of differential bonding strength on the inner and outer surfaces of the tensile member 6 with the bond between the tensile member and the label being stronger than that between the tensile member and the body stock. The term "bond" as used herein with reference to the tensile member is concerned only with the separating force required and not the point at which the separation occurs. In a typical application of the invention, the body stock will have a surface composed of a relatively short fiber material and some or all of the rupturing will take place within the body stock itself. The important thing, however, is that the tensile member 6 delaminates from the body stock 2 rather than from the label 4. The inner surface of the label 4 is designated 6*b* (FIG. 4). The tensile member 6 is thus removed when the label 4 is removed. The tensile member 6 can be about one half inch or more (typically one inch) in width and can be formed, for example, from kraft paper of 25 pounds per ream laminated to 0.00035 inch aluminum foil. Another preferred material for the strip 6 is about 25–40 pounds per ream high wet strength machine glazed kraft having a glue receptive outer surface.

The label 4 can be relatively light in construction compared to the normal label, for example excellent results are accomplished with a foil and kraft paper label as light as 25 pounds per ream representing a saving of about 0.75 to 1.0 cents per thousand square inches compared with the current cost of an ordinary label. Since the tensile function is provided by tape 6, the label can be formed from practically any material. The strip 6 is highly receptive to glue on its outer surface. By the term "glue receptive" as used herein, is meant surfaces free from a coating which would render it poorly adherent to glue. Similarly the term "poorly adherent" means that the natural ability of the paper to be glued is reduced.

The label 4 thus serves only as an oil and moisture barrier and as a surface for printed indicia 4a but does not provide major support to butt joint 7 since this purpose is fulfilled by the tensile member 6. Since the bond strength differential causes the tensile element 6 to separate from the body stock 2, as soon as the label is withdrawn the can will open easily when struck against a solid object. Removal of the tensile element weakens the butt joint by a factor of about 50% (assuming the tensile element 6 is of about the same thickness and strength as the liner, but at the least by a factor of about 20%).

The label 4 is bonded to the body 2 by two adhesive strips 15 and 16 in addition to being bonded to the tensile member 6. It will be seen that the strip 16 is relatively narrow compared with 15 and that there are unglued areas 18 and 20 on either side of the tensile element 6. The unglued area 18 is about an inch in width and the unglued area 20 is about a quarter of an inch in width. The extreme edges of the label 4 are free from adhesive. This is accomplished, for example, by scraping them free from adhesive just before the label is wound into tubular form with the underlying unglued edge 22 about an eighth of an inch wide or so and the overlying adhesive free edge 24 is about 3/32 of an inch wide. A glazed portion 26 appears where one edge overlies the next adjacent material.

The filled container appears as shown in FIG. 3. To open the container, one grasps the edge of the label, the adhesive free edge 24 of the label edge adjacent the collar cut C which functions as a tab T and withdraws the label as shown in FIG. 2. As this is done, the reinforcing strip or tensile member 6 is also removed since the bond **6*b* has greater strength than the bond 6*a* between the tensile member 6 and the body material 2**.

In FIGS. 5–10 is shown another embodiment of the invention. As in FIGS. 1–4, a relatively heavy body stock sheet 52 and label 54 is wound continuously onto a mandrel and travels from left to right in the figures thereby forming a helically extending butt joint 57 where the adjacent convolutions of the body stock 52 contact one another. Over the butt joint 57 is bonded a reinforcing tape 56 which can be thought of as a tensile member. The tensile member is adhered to the body stock 2 by means of adhesive **56*a* which does not extend all the way to the edges of the tensile member 56 for reasons to be described below. The liner 55 is formed from a relatively tough barrier material such as the composite of kraft paper and aluminum foil and is applied to the mandrel first so as to be wound inside the body stock 52**.

After the tensile member 56 has been bonded over the butt joint 57, the label 54 which functions as a protective coating and printing surface is applied and bonded to the underlying body stock only in specific locations as will be described below but not to the tape 56. After the tube has been completely formed, it is cut circumferentially into lengths as shown by dotted line 53. The tube is then cut circumferentially only partially through its thickness but through the labels 54 and the tensile element 56 at $C_1$. The cut $C_1$ does not extend through the body stock layer 52. The circumferential cut $C_1$ is preferably near one end of the container normally about one half of an inch from the end of the container. The container is now ready for filling and capping.

The finished package embodying the present invention is thus comprised in part of an elongated container body which is ordinarily cylindrical but in any case has circular configuration at all points on its longitudinal axis. The container body is composed of a plurality of layers of flexible sheet material. The butt joint 57 extends generally longitudinally of the core but as can be seen also extends helically. The inner protective liner 55 is formed from a flexible sheet material positioned adjacent and bonded to the inner wall of the core 52 to help prevent the loss of moisture and oil from the can. The outer protective label 54 is positioned adjacent to the outer surface of the core 52 as mentioned above to prevent ambient moisture from harming the container body and its contents. The tensile member 56 bridges the butt joint 57 and is adhered to the marginal edges of the container body element 52 on either side of the butt joint 57 by means of a suitable adhesive such as a resinous emulsion or hot melt adhesive.

The bottom cap 60 is normally applied before filling. The container is then filled with dough products, the cover 62 is applied to the top. The bottom covers are secured in place conventionally by crimping or seaming in commercially available equipment.

As seen in FIGS. 2, 3 and 4 the core of body stock member 52 is relatively thick compared with the liner and the label. It consists, for example of a heavy paperboard strip four inches wide and 0.026 inches in thickness and functions as a stiffening member to provide thickness and overall strength. The liner 55 consists for example of 25 lb. per 3000 ft.$^2$ kraft paper laminated to a 0.00035 inch aluminum foil to protect the core member 52 from moisture and oil. The outer surface or liner 55 is bonded to the core 52 by means of adhesive and as can be seen in FIG. 4, bridges the butt joint and secures the butt joint intact even after the subsequent removal of the label 54 and tensile member 56 as will be described below.

The label 54 is printed on its outside surface at 54a to provide information for the consumer concerning opening directions and baking directions for the packaged contents and functions as a moisture and oil barrier.

The label 54 is held in place by glue strips 65 and 66. While the width of the adhesive strips 56 and 66 can be varied widely and may comprise a series of dots or continuous strips, the strip 66 we have found convenient to make about half an inch in width while the strip 65 about five-eighths of an inch in width. This leaves, in a typical can, a copy zone 68 having a width about 2⅝ inches which is printed with indicia 49 representing descriptive material or coupons and the like. Thus, only about 1 inch in width of a total of 4 inches in width is devoted to gluing the label to the body stock and the remaining 3 inches of available material are free from adhesive. It will be seen that the tensile element 56 thus makes it possible to provide a relatively wide unglued copy zone. There is an unglued area 68 between the glue strips 65 and 66. The unglued area 68 is about 2⅝ inches in width and provides a surface for printed indicia 49 such as directions for using the product, photographs of the finished product, etc. The extreme edges of the label 54 are free from adhesive for example by being scraped free from adhesive just before being wound into tubular form with the underlying unglued edge 72 being about an eighth of an inch wide or so and the overlying adhesive free edge 74 being about three-sixteenths of an inch wide. A glazed portion 76 appears where the edge overlies the next adjacent convolution.

As can be best seen in FIGS. 8, 9 and 10 the tensile element 56 is bonded at its center over the longtudinally extending butt joint but is not bonded at the periphery by providing two adhesive free areas **56*b* and 56*c* which define at the upper end thereof adjacent the collar cut C a lifting tab $T_2$ (FIG. 9). The lifting tab $T_2$ at the end of the strip 56 can be thought of as a means for removing the reinforcing strip from the underlying body stock material 52**.

The filled container appears generally as shown in FIG. 7. To open the container, one grasps the edge of the label, the adhesive free portion of the label edge adjacent the circumferential cut C which functions as a tab $T_1$ and withdraws the label as shown in FIG. 6. When this is done the reinforcing strip or tensile member 56 is exposed and removed by tab $T_2$.

The width of the tensile member can vary but usually is at least a half an inch wide. Since the tensile function is provided by tape 56, the label can be formed from practically any material.

The tensile members 6 and 56 are usually about an inch in width and can be formed, for example, from a composite aluminum foil and kraft paper laminate, for example kraft paper of 25 lbs. per 3,000 ft.$^2$ laminated to 0.00035 inch aluminum foil. The labels 4 and 54 can be relatively light in construction compared to the normal label. For example, excellent results are accomplished with a foil and kraft paper label as light as 25 lbs. per 3,000 ft.$^2$ representing a saving of about 0.75 to 1.0 cents per thousand square inches compared with the current cost of ordinary label being about 7.5 to 9.5 cents per thousand square inches. It can thus be seen that the labels 54 and 4 serve only as oil and moisture barriers and have a surface for printed indicia but do not function as strengthening members for the butt joint, this purpose being fulfilled by the tensile member.

After the tensile element 56 is removed, the butt joint is weakened which allows the can to open easily when struck against a solid object. The strip removal usually weakens the butt joint by a factor of from about 20%–50% or more assuming the tensile element 56 is of about the same thickness and strength as the liner.

The tensile strip 56 can be of the same material as strip 6 and need not be poorly adherent to glue provided that no glue is allowed to come in contact with the outer surface of the strip with a vinyl slip coating on its outer surface which makes it relatively poorly adherent to glue.

After the label and the reinforcing strip 6 or 56, as the case may be, has been removed the can is opened by striking the separation line against a solid object such as the edge of a table. This causes the liner bridging the butt joint on the inside surface to rupture along its almost full length simultaneously thereby causing the can to open from one end to the other. Then, by twisting the ends of the container lightly, the opening can be enlarged thereby allowing the biscuits or other dough products to be quickly removed.

It can thus be seen that the package in accordance with the invention provides typically 10% reduction in the label cost compared with packages not using a reinforcing strip and at the same time provides almost double the amount of available printing surface. Since no metallic labels are needed, the advantage of electro-assist printing can be obtained.

What is claimed is:

1. A spirally wound composite cylindrical can adapted to be opened in two stages and having discrete label and reinforcing elements for packaging fresh leavened dough products, said can comprising:

a. a stiffening bodystock sheet of spirally wound configuration, b. a butt joint between the adjacent side edges of the bodystock sheet, the butt joint extending generally longitudinally and spirally thereof, c. a liner composed of a flexible sheet material bonded within the bodystock sheet, d. a tensile element comprising a reinforcing strip removably, adhesively bonded to the outer surface of the bodystock sheet over the butt joint, the adhesive bond between the reinforcing strip and the bodystock sheet being rupturable and serving to hold the adjacent edges of the butt joint in close proximity with one another until the reinforcing strip is removed, e. a label formed from flexible sheet material removably bonded to the outer surface of the bodystock sheet but unbonded to the adjacent outer surface of the reinforcing strip and portions of the bodystock laterally of the reinforcing strip to define an unbonded center section intermediate the side edges of the label.

f. a circumferentially extending collar cut through the label and reinforcing strip, the collar cut being positioned relatively close to one end of the container, g. a portion of the edge of the label adjacent to the collar cut being unbonded to the underlying bodystock layer whereby the lifting tab is defined for the label allowing the label to be lifted manually and peeled away from the underlying bodystock material during a first opening stage without removing the reinforcing strip and, h. lifting tab means operatively associated with the reinforcing strip to thereafter permit the separate removal of the reinforcing strip in a second opening stage from the bodystock to thereby weaken the butt joint by a factor of at least about 20% when the reinforcing strip is removed, i. whereby the butt joint can then be separated substantially its entire length from one end of the can to the other to provide an opening in the can sufficiently large to withdraw the contents therethrough.

2. The container according to claim 1 wherein the means for removal of the reinforcing strip comprises an unsealed portion at the end of the reinforcing strip adjacent to the collar cut which is exposed after the label is removed, said unsealed portion of the reinforcing strip being unbonded to the underlying bodystock material thereby defining a pull tab allowing the reinforcing strip to be removed manually from the body in the second opening stage after the label has been removed.

3. The container of claim 1 wherein the tensile element comprises an elongated strip of flexible sheet material bonded to the underlying body stock material and an adhesive free margin on at least one edge thereof between the container body stock and the strip to define a lifting tab at the upper edge thereof adjacent the collar cut for removal of the tensile element.

4. The container of claim 1 wherein the tensile element is an elongated strip of flexible sheet material bonded to the underlying bodystock material, the tensile element being bonded to the bodystock with sufficient strength to cause the tensile element to remain bonded to the bodystock when the label is removed and printed indicia on the inside surface of the label in the area over the reinforcing strip and extending laterally thereof.

5. The container of claim 1 wherein the tensile element comprises an elongated strip of flexible sheet material bonded to the underlying body stock material and an adhesive free margin on at least one edge thereof between the container body stock and the strip to define a lifting tab at the upper edge thereof adjacent the collar cut for removal of the tensile element, the label having an adhesive free area located over the tensile element and extending laterally beyond the side edges of the tensile element, said adhesive free area defining a printing surface and printed indicia located within said adhesive free area.

6. The container of claim 1 wherein a dough product is packed within the can under pressure and top and bottom caps are sealed to the ends thereof.

* * * * *